US006208294B1

(12) United States Patent
Kobayakawa et al.

(10) Patent No.: US 6,208,294 B1
(45) Date of Patent: Mar. 27, 2001

(54) ARRAY ANTENNA RECEIVING DEVICE

(75) Inventors: Shuji Kobayakawa; Yoshinori Tanaka; Masafumi Tsutsui, all of Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/313,612

(22) Filed: May 18, 1999

(30) Foreign Application Priority Data

Sep. 14, 1998 (JP) ..... 10-260667

(51) Int. Cl.[7] ..... H01Q 3/24
(52) U.S. Cl. ..... 342/373; 342/368; 342/377
(58) Field of Search ..... 342/368–377, 342/165, 173, 174, 367; 375/130; 370/315–321, 328–338, 441

(56) References Cited

U.S. PATENT DOCUMENTS 3,646,558 * 2/1972 Campanella ..... 342/373
4,882,589 * 11/1989 Reisenfeld ..... 342/374
5,767,806 * 6/1998 Watanabe et al. ..... 342/373
5,933,112 * 8/1999 Hiramatsu et al. ..... 342/372
5,999,120 * 12/1999 Yamada ..... 342/174

FOREIGN PATENT DOCUMENTS 8330837 12/1996 (JP) .
9162799 6/1997 (JP) .

* cited by examiner

*Primary Examiner*—Bernarr E. Gregory
(74) *Attorney, Agent, or Firm*—Helfgott & Karas, P C.

(57) ABSTRACT

An array antenna receiving device which compensates a phase deviation to perform an efficient beam forming while keeping phase difference information between receivers determined by the arrival direction of a user signal in a communication area to which an antenna element is directive and the array of antenna elements in a radio base station. An analog beam former provides a composite beam so that a phase difference between adjacent beams may have a fixed value determined by beams to be selected. A phase compensator provides digital signals of receivers with phase correction quantities based on any one of the digital signals so that phase differences between the antenna elements may have a fixed value.

11 Claims, 18 Drawing Sheets

4×4 ANALOG BEAM FORMER $\Theta = -\pi/2,\ \Phi 1 = \Phi 4 = -\pi/4,\ \Phi 2 = \Phi 3 = 0$

RADIATION CHARACTERISTIC (4×4 ANALOG BEAM FORMER)

PHASE CHARACTERISTIC (4×4 ANALOG BEAM FORMER)

8×8 ANALOG BEAM FORMER $\Theta = -\pi/2$, $\Phi 1 = \Phi 8 = 6\pi/16$, $\Phi 4 = \Phi 5 = 2\pi/16$,
$\Phi 9 = \Phi 10 = \Phi 15 = \Phi 16 = 4\pi/16$,
$\Phi 2 = \Phi 3 = \Phi 6 = \Phi 7 = \Phi 11 = \Phi 12 = \Phi 13 = \Phi 14 = 0$

RADIATION CHARACTERISTIC (8×8 ANALOG BEAM FORMER)

LINEAR ARRAY ANTENNA

PHASE ROTATOR

PHASE CORRECTION ARITHMETIC PORTION (1)

PHASE DEVIATION ARITHMETIC PORTION (1)

PHASE CORRECTION ARITHMETIC PORTION (2)

PHASE DEVIATION ARITHMETIC PORTION(2)

RADIATION CHARACTERISTIC AFTER INVERSION

PHASE CHARACTERISTIC AFTER INVERSION

ARRAY ANTENNA RECEIVING DEVICE

BACKGROUD OF THE INVENTION

Field of the Invention

The present invention relates to an array antenna receiving device, and in particular to an array antenna receiving device such as a multibeam antenna or, an adaptive array antenna receiving device in which a plurality of antenna elements arrayed in parallel in a radio base station of a cellular mobile communication system and received signals are converted into digital signals, which are provided with a predetermined amplitude and phase rotation by operations to form a desirable composite beam pattern.

The applications of the multi-beam antenna or the adaptive array antenna receiving device which use digital signal processing in the radio base station of the cellular mobile communication system enable an enhanced gain followed by the beam pattern being equivalently focused. Further, these applications also increase the number of users accommodated in a single cell or sector followed by the reduction of interferences within a communication area due to the directivity.

However, the realization of the array antenna receiving device with signal processing in a digital domain requires a nonlinear device such as a low noise amplifier (LNA) and mixers for a frequency conversion. These devices are required for the receivers respectively which convert the received signals at the antenna elements into base band signals. This may cause a phase deviation between the receivers, which could prevent an efficient beam to be formed and incur characteristic deterioration.

Furthermore, since each of the receivers has a phase difference with respect to one another, which is determined by the arrival direction of a user signal in a communication area (cell or sector) to which the antenna element and the array of antenna elements are directed at, it is necessary to correct or compensate only the phase deviation while maintaining the phase difference information between the receivers, which is required for the composite or synthetic process of the received signals at the antenna elements.

For the phase correction performed during beam forming in a prior art array antenna receiving device, a method such as performing a calibration between the receivers periodically, e.g. once a day, is required. However, this method is no more than beam forming in an indefinite phase condition upon the occurrence of a dynamic phase deviation, which leads to low reliability of the device.

On the other hand, there is a view that the array antenna receiving device adopting an adaptive processing method does not have a substantial phase deviation between the receivers, if any, since the amplitude and phase including the phase deviation are controlled. However, a slow convergence rate in the adaptive processing, and a separation of the phase deviation from the amount of the amplitude and phase control in the adaptive processing is required for transmission beam forming for the amount of the reception time controlled upon transmission.

Further, an array antenna receiving device as shown in FIG. 22 has also been proposed, in which assuming that the number of array antenna elements in a single sector be "n". Thus, radio frequency signals from antenna elements 1*l*–1*n* are provided at an analog beam former 2 with a certain (fixed) amplitude and phase rotation to form a desirable antenna pattern. RF signals received by such beams are converted into base band signals and then converted into digital signals by receivers 3*l*–3*n*. The outputs of the receivers 3*l*–3*n* are then selectively switched by a selector 9 to select the largest beam output in power, thereby avoiding phase deviation between the receivers.

However, the prior art array antenna receiving device shown in FIG. 22 does not perform adaptive beam forming in the digital domain at a latter stage of the device (not shown) so that further characteristic improvements are not obtained. Therefore, without any phase correction by some means, an array antenna receiving device with higher reliability and better performance is not realized, resulting in a problem that an adaptive array antenna or the like is not applicable to a radio base station.

SUMMARY OF THE INVENTION

It is accordingly an object of the present invention to provide an array antenna receiving device that compensates a phase deviation to enable efficient beam forming while maintaining phase difference information between receivers using the arrival direction of a user signal in a communication area to which an antenna element and the array of antenna elements in a radio base station is directed.

These and other objects are made by an array antenna receiving device according to the present invention arranged such that an analog beam former makes a composite beam so that a phase difference between adjacent beams have a fixed value determined by the beams selected. Further, a phase compensator provides digital signals from receivers with phase correction quantities based on any one of the digital signals so that phase differences between the antenna elements have the fixed value. Namely, it is arranged so that a phase deviation of an active circuit portion (receiver) is compensated by using inter-antenna branch phase information of a passive circuit portion such as antenna or analog beam former without any phase deviation. Thus, it becomes possible to perform beam forming, which is higher in adaptive processing reliability and efficiency due to the signals produced after the phase compensation. This contributes to a realization of a multi-beam antenna, or an adaptive array antenna receiving device in the digital domain.

Also, the beam former may comprise power distribution circuits and phase shifters.

Furthermore, the array antenna receiving device according to the present invention also maintains a generator for generating an uplink pilot signal forming a reference for any direction in a communication area. In this case, the phase compensator converts the uplink signal into the digital signals provided with the phase correction quantities.

Alternatively, the array antenna receiving device according to the present invention also may include a generator for generating an uplink pilot signal to distribute output signals of the generator to receiving routes. In this case, the phase compensator uses the uplink signal as receiving signals between the antenna elements and the beam former with the fixed phase difference to generate the digital signals provided with the phase correction quantities.

The array antenna receiving device according to the present invention may also include an inverter circuit that performs an operation inverse to the beam former so that output signals of the phase compensator may be equivalent to the receiving signals per a single antenna element; and an adaptive processing portion that combines output signals of the inverter circuit to form the adaptive antenna pattern.

BRIEF DESCRIPTION OF THE DRAWINGS

Throughout the figures, like reference numerals indicate identical or corresponding portions.

DETAILED DESCRIPTION

Figure 1A:
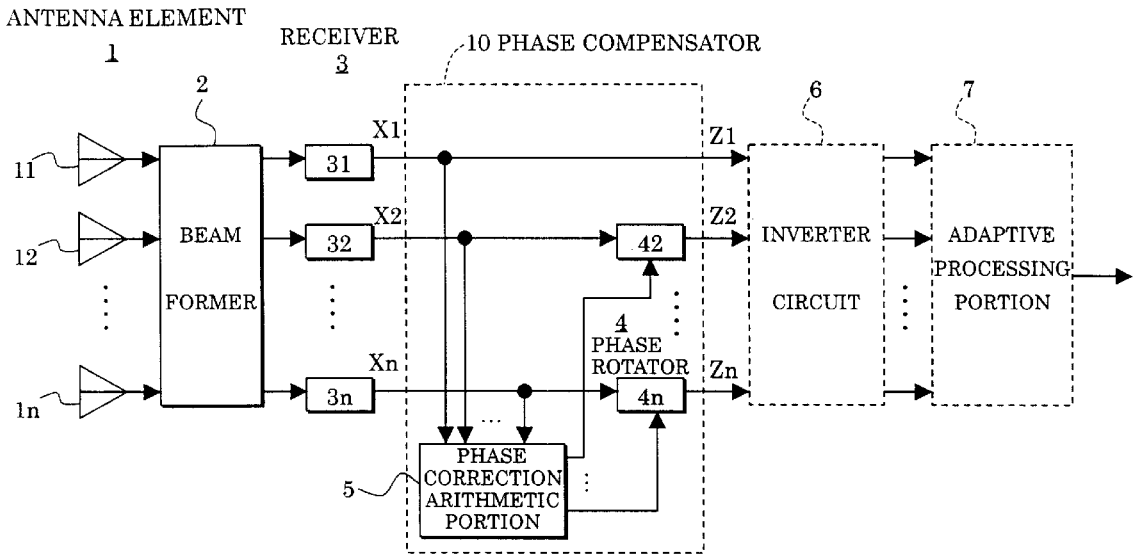
FIGS. 1A and 1B are block diagrams showing arrangements of an array antenna receiving device according to the present invention.
Figure 1B:
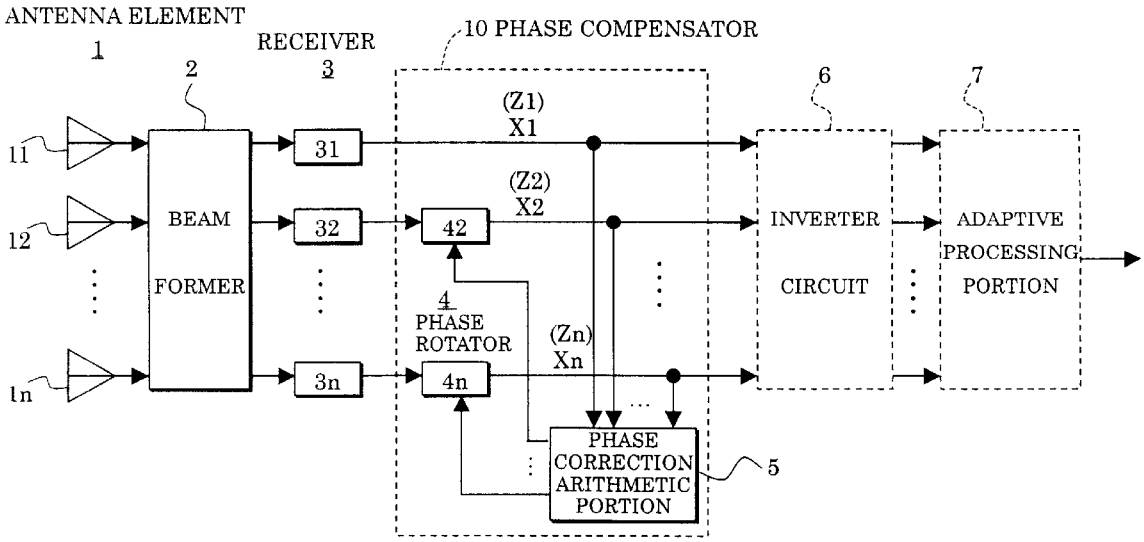

FIGS. 1A and 1B show arrangements of an array antenna receiving device according to the present invention. In particular, FIG. 1A shows a feed forward arrangement and FIG. 1B shows a feedback arrangement.

Figure 22:
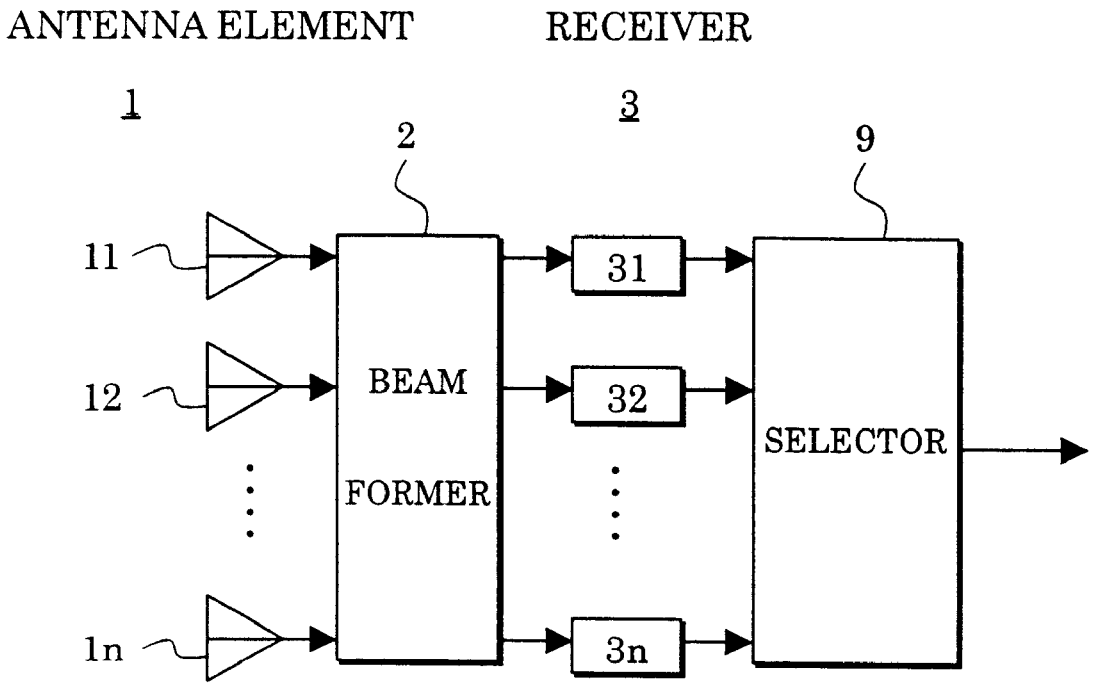
FIG.22 PRIOR ART
FIG. 22 is a block diagram showing a prior art device.

In FIG. 1A, antenna elements 11–1*n* (hereinafter occasionally and generally referred to as "1"), an analog beam former 2, and receivers 31–3*n* (hereinafter occasionally and generally referred to as "3") are provided in the same manner as FIG. 22.

In FIG. 1A, radio signals received by the antenna elements 1 are input to the beam former 2 where the radio signals are combined with a particular weight and phase, and provided at output terminals. Each output of the beam former 2 is subject to a particular amplification and frequency conversion to produce base band signals for passing through the receivers 3. The receivers 3 further convert the base band signals into digital signals by A/D conversion.

As can be seen, the receivers 3 are connected to a phase compensator 10. As shown by dotted-lines in FIG. 1A, the phase compensator 10 is further connected to an inverter circuit 6 for performing an inverse operation of the beam former 2 so that the output signals of the phase compensator 10 may be equivalent to those of the antenna elements 1 except that they are digital signals. The inverter circuit 6 is further connected to an adaptive processing portion 7 for compositing the output signals of the inverter circuit 6 to form an adaptive antenna pattern. The inverter circuit 6 may also have a through-put arrangement, where the inverter is eliminated.

The phase compensator 10 includes phase rotators 42–4*n* (hereinafter occasionally and generally referred to as "4"), which are connected between the receivers 32–3*n* and a phase correction (quantity) arithmetic portion 5. The phase correction arithmetic portion receives the output signals X1–X*n* from the receivers 31–3*n* to calculate phase correction quantities as noted below, which are supplied to the phase rotators 42–4*n*. The digital signal from the receiver 31 is used as a reference for the digital signals of the receivers 3.

In the array antenna receiving device of FIG. 11B, a phase compensator 10 is provided between the receivers 3 and the inverter circuit 6 in the same manner as FIG. 1A. Since this array antenna receiving device adopts a feedback arrangement, a phase correction arithmetic portion 5 is arranged so that it receives an output signal X1 from receiver 31 and output signals X2–X*n* from the phase rotators 42–4*n* to provide phase correction quantities for the phase rotators 42–4*n*.

Figure 2:
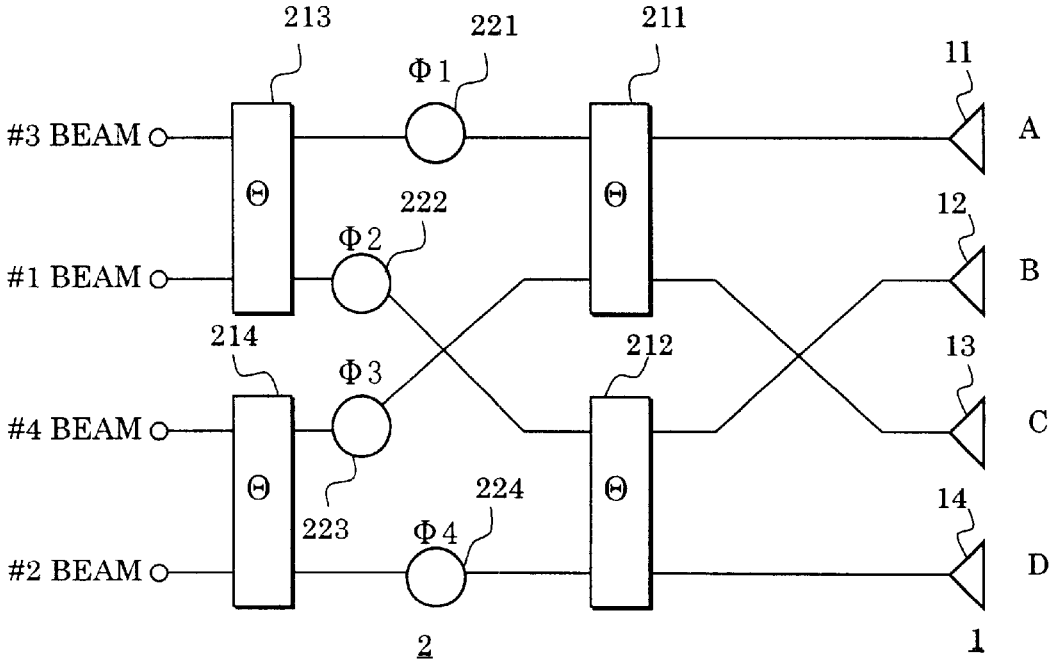
FIG. 2 is a block diagram showing an example of a 4×4 analog beam former used in an array antenna receiving device according to the present invention.

FIG. 2 shows an example arrangement of the analog beam former 2 shown in FIGS. 1A and 1B, which is specifically an analog-domain beam former known as a "Butler Matrix" in the form of 4 (inputs)×4 (outputs). As shown in FIG. 2, this beam former 2 includes −90° hybrid circuits 211–214 (Θ), which are known as power distribution circuits for respectively distributing one input as two outputs with a phase difference of −90° between each other, 45° phase shifters 221, 224 (Φ1, Φ4), and 0° phase shifters 222, 223 (Φ2, Φ3). In this example, the hybrid circuit 211 receives the output signals A,C respectively from the antenna elements 11, 13 and provides one of the output signals to hybrid circuit 213 through the phase shifter 221 and the other output signal to the hybrid circuit 214 through the phase shifter 223. The hybrid circuit 212 receives the output signals B, D respectively from the antenna elements 12,14, and provides one of the output signals to the hybrid circuit 213 through the phase shifter 222 and the other output signal to the hybrid circuit 214 through the phase shifter 224. Therefore, the hybrid circuit 213 outputs a #3 beam and #1 beam, and the hybrid circuit 214 outputs a #4 beam and #2 beam, as shown in the figure.

TABLE I

| (1) 4 × 4 BEAM FORMER | | | |
|---|---|---|---|
| | REGION | | |
| | a | b | C |
| ARRIVAL ANGLE (°) | −22~−8 | −7~7 | 8~22 |
| $\Delta\theta_{nm}$ (°) | ±180 | 0 | ±180 |

| (2) 8 × 8 BEAM FORMER | | | | | | | |
|---|---|---|---|---|---|---|---|
| | REGION | | | | | | |
| | a | b | C | d | e | f | g |
| ARRIVAL ANGLE (°) | −25~−19 | −18~−11 | −10~−4 | −3~3 | 4~10 | 11~18 | 19~25 |
| $\Delta\theta_{nm}$ (°) | −157.5 | ±180 | 157.5 | 0 | −157.5 | ±180 | 157.5 |

Figure 3:
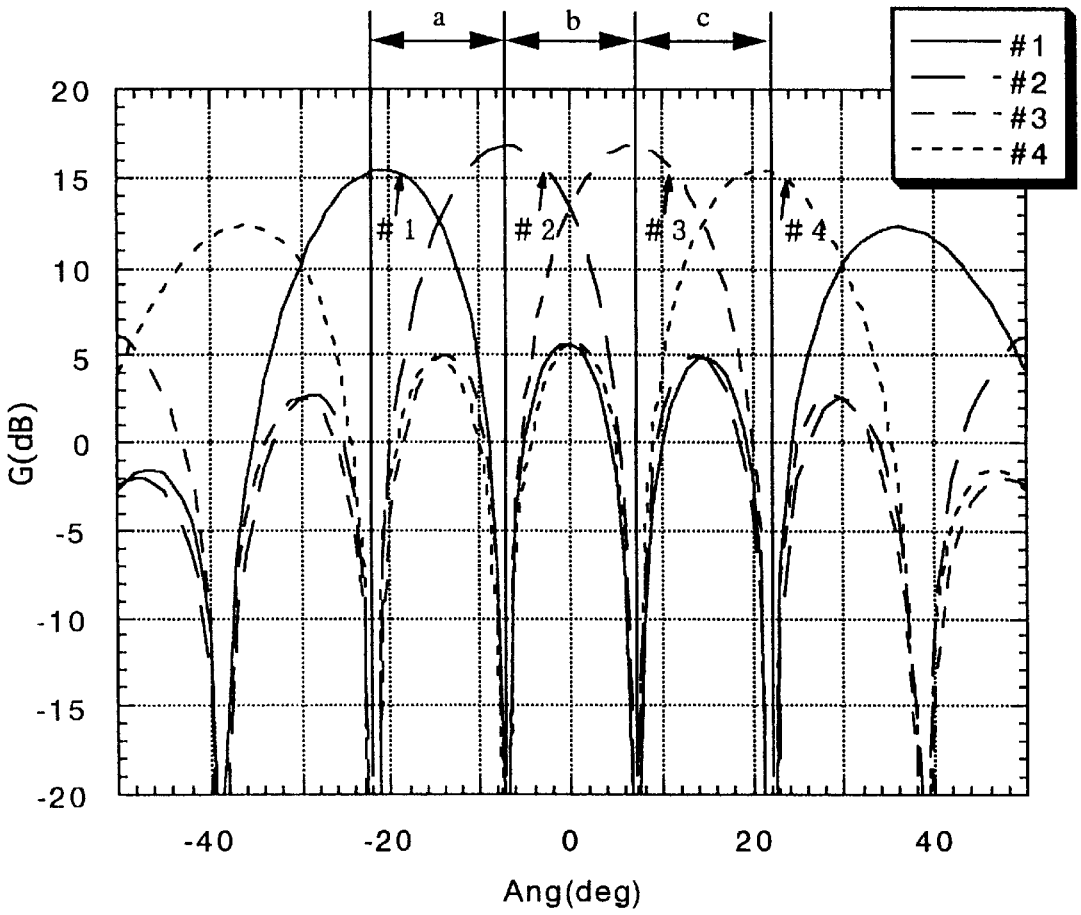
FIG. 3 is a graph showing a radiation characteristic of a 4×4 analog beam former used in an array antenna receiving device according to the present invention.
Figure 4:
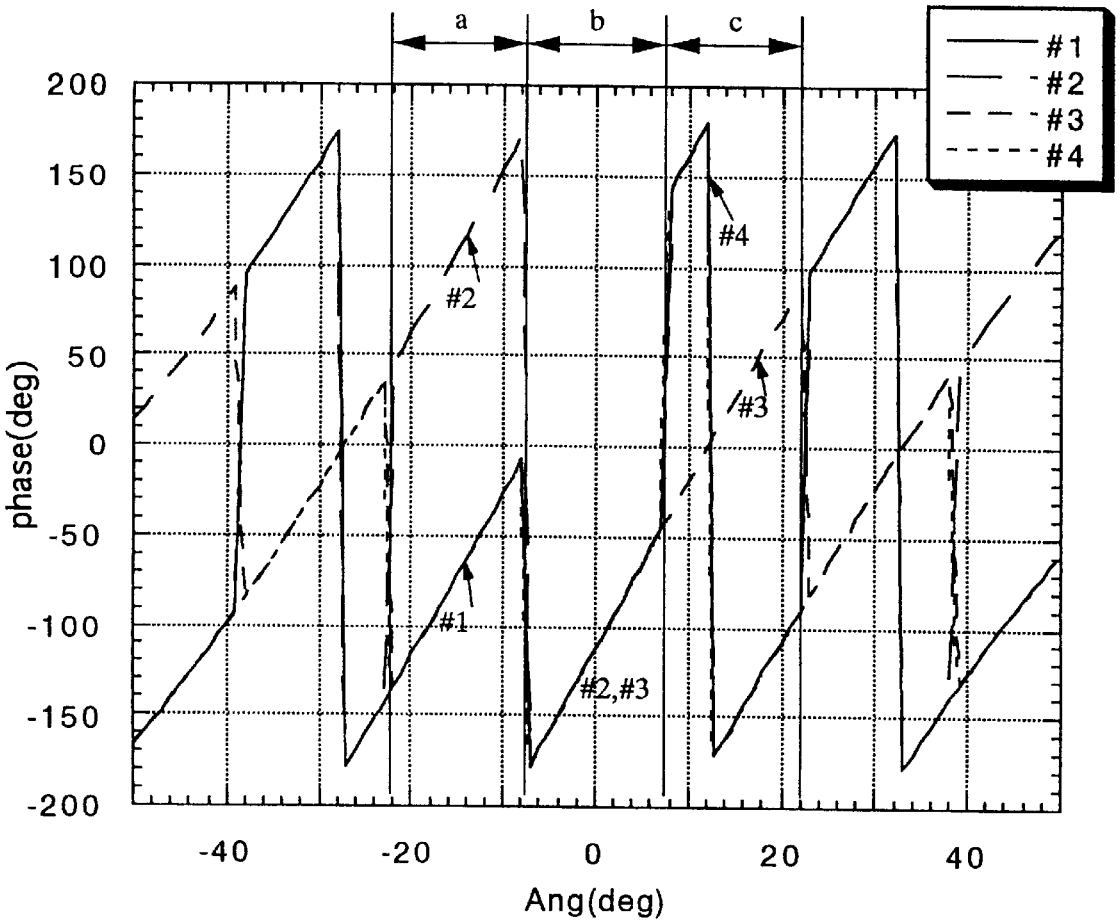
FIG. 4 is a graph showing a phase characteristic of a 4×4 analog beam former used in an array antenna receiving device according to the present invention.

FIG. 3 shows a radiation characteristic of the analog beam former 2 of FIG. 2, while FIG. 4 shows a phase characteristic of the same. As shown in FIG. 3, #1–#4 beams are output in order.

In view of the beam former 2 producing such a radiation characteristic with reference to FIG. 4, it is found that phase differences between adjacent beams (main lobes) have fixed values as indicated by the ordinate over arrival angle regions a–c as indicated by the abscissa.

Figure 5:
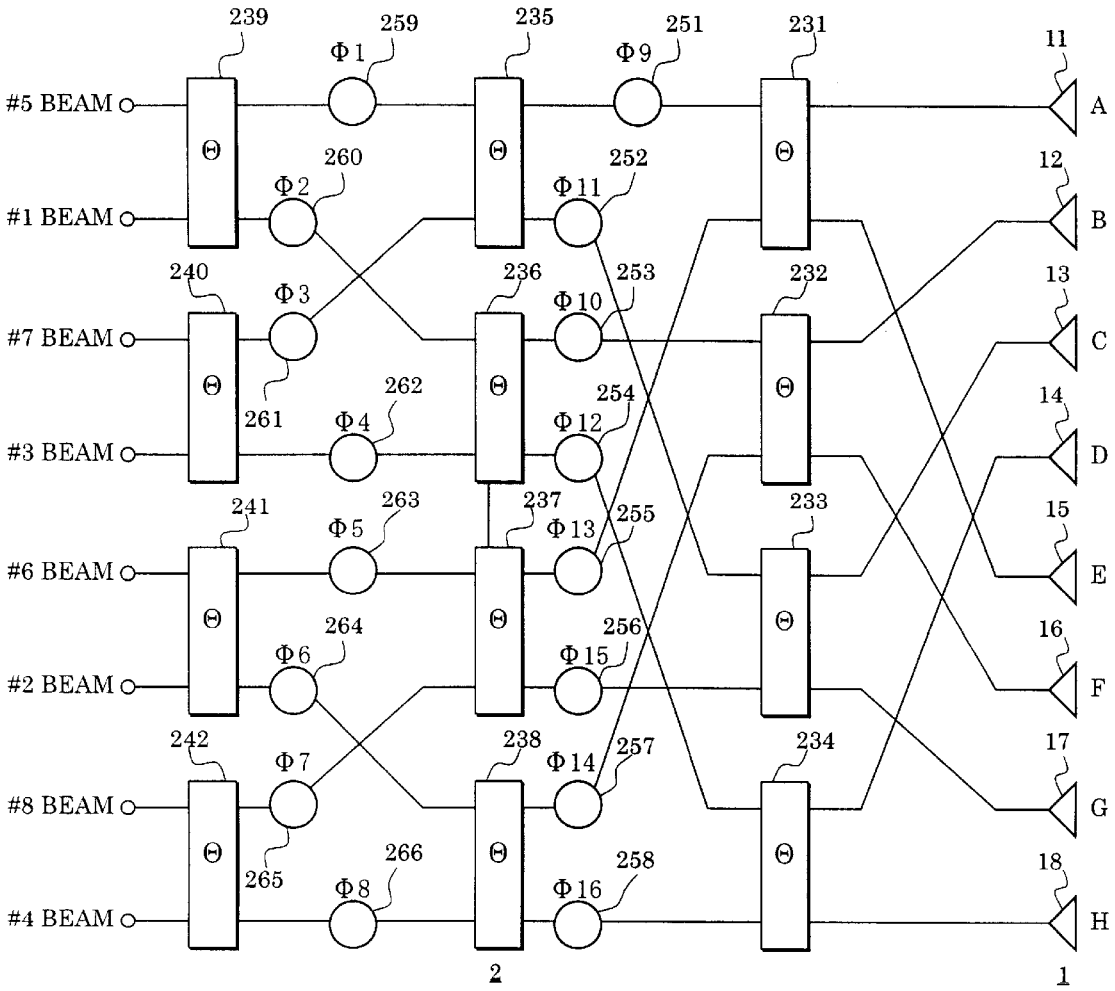
FIG. 5 is a block diagram showing an example of an 8×8 analog beam former used in an array antenna receiving device according to the present invention.

FIG. 5 shows an arrangement (2) of the analog beam former 2, which is composed of −90° hybrid circuits 231–242, 67.5° phase shifters 259, 266 (Φ1, Φ8), 22.5° phase shifters 262, 263 (Φ4, Φ5), 45° phase shifters 251, 252, 256, 258 (Φ9, Φ10, Φ15, Φ16), and 0° phase shifters 260, 261, 264, 265, 252, 254, 255, 257 (Φ2, Φ3, Φ6, Φ7, Φ11, Φ12, Φ13, Φ14), in the form of 8 inputs×8 outputs.

Figure 6:
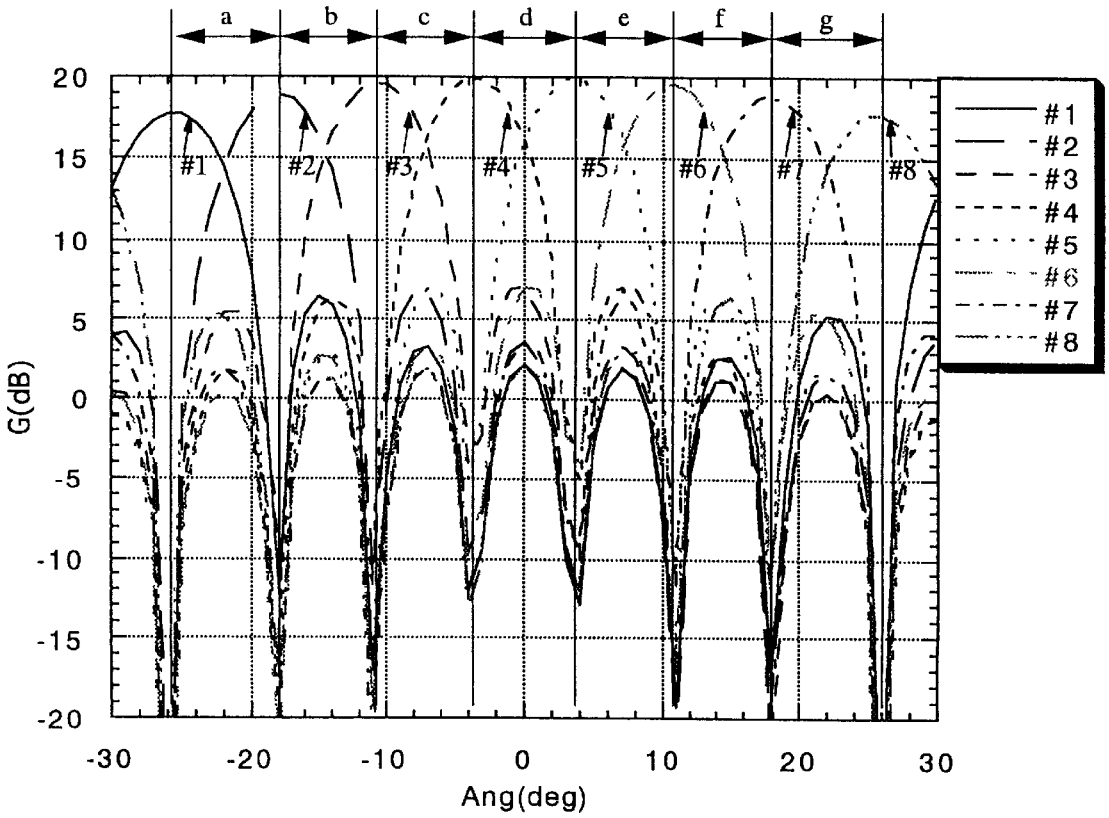
FIG. 6 is a graph showing a radiation characteristic of an 8×8 analog beam former used in an array antenna receiving device according to the present invention.

In this example, when the output signals A–H of the antenna elements 11–18 as shown in the figure are input to the analog beam former 2, a #5 beam, #1 beam, #7 beam, #3 beam, #6 beam, #2 beam, #8 beam, and #4 beam are output as seen from the top of the figure. FIG. 6 shows a radiation characteristic of the analog beam former 2 shown in FIG. 5, in which #1–#8 beams are output in order.

Figure 7:
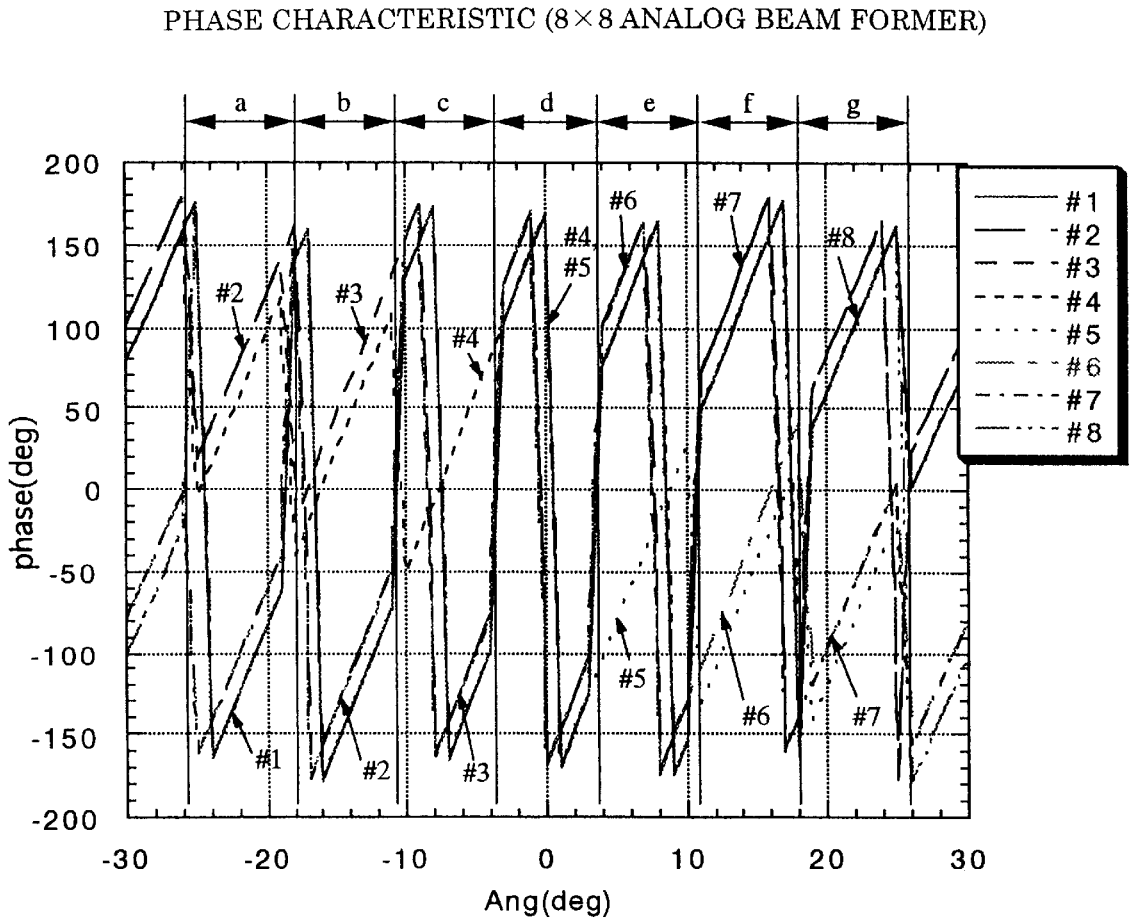
FIG. 7 is a graph showing a phase characteristic of an 8×8 analog beam former used in an array antenna receiving device according to the present invention.

FIG. 7 shows a phase characteristic of the 8×8 Butler Matrix, from which it is shown that this analog beam former has fixed phase differences over arrival angle regions a–g like the example in FIG. 4. Thus, the arrival angle regions and the fixed phase difference values $\Delta\theta_{nm}$ corresponding to the arrival angle regions in the analog beam former 2 are illustrated as in the following table 1. This table is obtained, assuming that the interval of the antenna elements 1 is λ and the respective radiation pattern of the antenna elements 1 is a beam having a half power beam width of 60°.

When a user's uplink signals are received at the antenna elements 1 respectively with any adjacent beams, the beam former 2 will have a fixed value of the phase difference between the uplink signals depending on the combination of the adjacent beams to be selected. In other words, a composite beam will be made so that the phase difference between adjacent output beams obtained from the output signals of the antenna elements 1 may have a fixed value determined by the combination of the output beams to be selected. Therefore, the presence of a phase deviation in a receiver system will give rise to a deviation from the fixed value.

Figure 8:
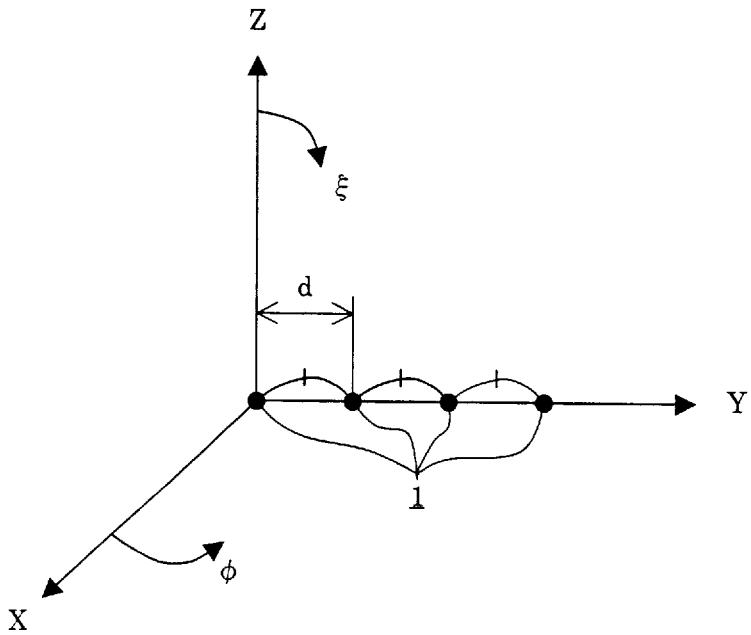
FIG. 8 is a diagram illustrating a linear array antenna used in an array antenna receiving device according to the present invention.

The present invention is based in principle on this deviation being corrected and restored to the fixed value determined by the beams to be selected. More specifically paying attention to a single sector, and assuming that the number of users existing within the area is k and the number of the array antenna elements which is supposed to be a linear array antenna as illustrated in FIG. 8 is n, the user signals received by the antenna elements 1 shown in FIG. 1 are combined by the beam former 2, and then output from the receivers 3.

For example, when the uplink signal of a user "i" is received by the receivers 3 at the same time for the #1 and #2 beams which are adjacent to each other as shown in FIG. 4, the output signals X1 and X2 are given by the following equations.

$$X1=A1\cdot\exp[j(\alpha_i(t)+\varnothing_1)] \quad \text{Eq.(1)}$$

$$X2=A2\cdot\exp[j(\alpha_i(t)+\Delta\theta_{12}+\varnothing_2)] \quad \text{Eq.(2)}$$

where

α i (t): an arbitrary phase (i=1, 2, . . . ,k) in the beam composite output of the ith user signal.

$\Delta\theta_{12}$: a phase rotation, which exhibits a fixed value within a certain arrival angle region, determined by the adjacent #1 and #2 beams to be noted, assuming that X1 is a reference.

A1, A2: amplitudes of user signals at the #1 and #2 beams as selected.

$\varnothing_1$, $\varnothing_2$: phase deviations due to the receivers 31 and 32.

The following operations will be made from the output signals X1 and X2.

$$Y12=X2\cdot X^*1=A1\cdot A2\cdot\exp[j(\varnothing_2-\varnothing_1+\Delta\theta_{12})] \quad \text{Eq.(3)}$$

The phase term in Eq.(3) is given by the following equation.

$$\arg(Y12)=\varnothing_2-\varnothing_1+\Delta\theta_{12} \quad \text{Eq.(4)}$$

$\Delta\theta_{12}$ in Eq.(4) depends on the #1 and #2 beams to be selected, and has a known fixed value as illustrated in the above Table 1 in any arrival angle region. Therefore, the subtraction of the fixed value enables the phase difference D between the receivers 31 and 32 to be derived as given by the following equation.

$$\Phi=\varnothing_2-\varnothing_1 \quad \text{Eq.(5)}$$

With this phase difference (D for the phase correction of the signal X2 as given by the following equation, the phase-corrected output Z2 can be expressed by the following equation incorporating Eq.(2).

$$Z2=X2\cdot\exp[-j\Phi)]=A2\ \exp[j(\alpha_i(t)+\varnothing_1+\Delta\theta_{12})] \quad \text{Eq. (6)}$$

Meanwhile, the signal X1 is a reference signal not subject to any phase correction so that X1=Z1. Being compared with Eqs.(1) and (2), Eq.(6) excludes $\varnothing_2$, so that except the phase difference $\Delta\theta_{12}$ determined by the #1 and #2 beams to be selected the signals $Z_1$ and $Z_2$ have a common term of exp [j(αi(t)+0 1)], which means that the phase deviation between the adjacent #1 and #2 beams has been compensated.

This operation performed in order between adjacent beams will phase compensate for all of the receiver's routes. It is noted that the phase correction for any adjacent beams requires an operation in view of the last phase correction quantity between the last adjacent beams. Thus, the phase compensator 10 outputs digital signals converted from the output signals of the receivers 3 and provided with a phase correction quantity so that the phase difference between the beams may have the fixed value on the basis of the digital signals of the receivers 3.

The above-noted arithmetic portion may use a signal, e.g. a signal at an intersecting point between the #1 and #2 beams in FIG. 3. This signal is higher in reception level as any one of the digital signals to be selected, among arrival signals, in the same direction, of beams having adjacent directivities and being simultaneously received.

Alternatively, the arithmetic portion may use an average value of signals in excess of a certain level as any one of the digital signals to be selected among arrival signals in the same direction of beams having adjacent directivities and being simultaneously received.

Figure 9:
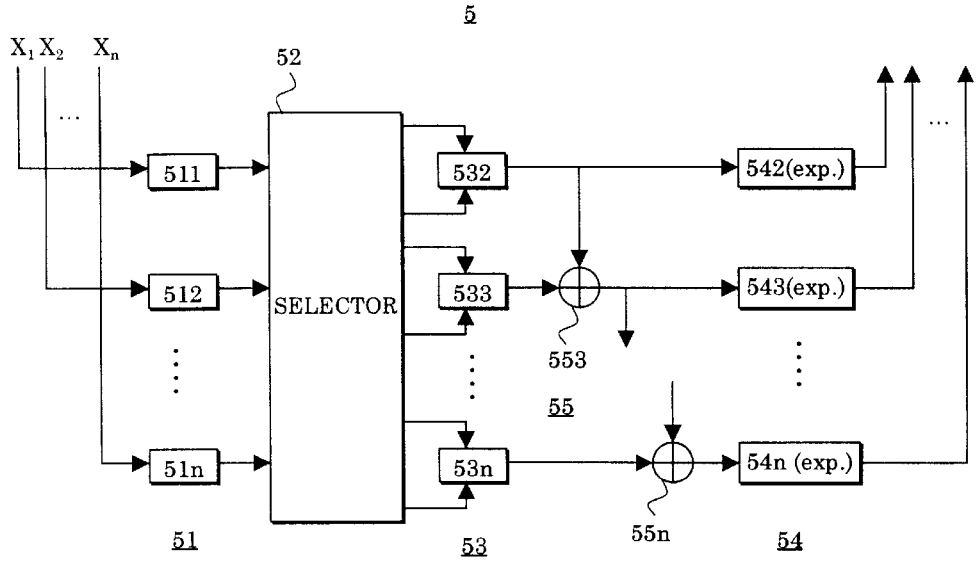
FIG. 9 is a block diagram showing an embodiment of a phase correction arithmetic portion used in an array antenna receiving device according to the present invention.

FIG. 9 shows an embodiment (1) of the phase correction arithmetic portion 5 in the feed forward-arranged phase compensator 10 used in an array antenna receiving device according to the present invention shown in FIG. 1A. In this embodiment, the output signals X1–XN from the receivers 31–3*n* are supplied to searchers 511–51*n* (generally referred to as "51"), in which valid paths of the signals are extracted on the supposition of a CDMA (Code Division Multiple Access) system.

The output signals of the searchers 511–51*n* are supplied to a selector 52, in which adjacent two beams are simultaneously detected. This enables a higher-level signal such as simultaneously detected by the #1 and #2 beams in the example of FIG. 3 is selectively output. The selector 52 is connected to phase deviation arithmetic portions 532–53*n* (generally referred to as "53"). The phase deviation arithmetic portions 53 are shown in detail in FIG. 10, where the signals selected by the selector 52 are used to execute the above Eqs.(3)–(5).

The output signals of the phase deviation arithmetic portions 532–53*n* are branched into two. One is forwarded to phase correction weight calculators 542–54*n*, while the other to adders 553–55*n* for the addition to the output signals of the phase deviation arithmetic portions 532–53*n* in the next object beam combination.

The phase correction quantities thus determined between all of the adjacent beams are performed with a complex operation (exp.) at phase correction weight calculators 542–54*n* (generally referred to as "54"), and then supplied to the phase rotators 42–4*n* for the phase correction.

Figure 10:
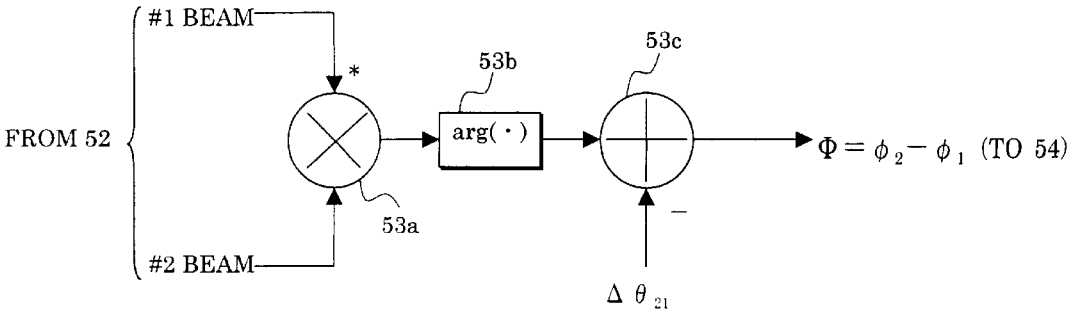
FIG. 10 is a block diagram showing an embodiment of a phase deviation arithmetic portion used in an array antenna receiving device according to the present invention.

The phase deviation arithmetic portions 53 shown in FIG. 10 are respectively composed of a multiplier 53a, a phase term calculator 53b, and a subtracter 53c. The multiplier 53a executes the above Eq.(3), the phase term calculator 53b executes Eq.(4), and the subtracter 53c removes the fixed phase difference $\Delta\theta_{12}$ from Eq.(4), whereby the phase difference D of the receivers 31,32 given by Eq.(5) is continuously output.

Figure 11:
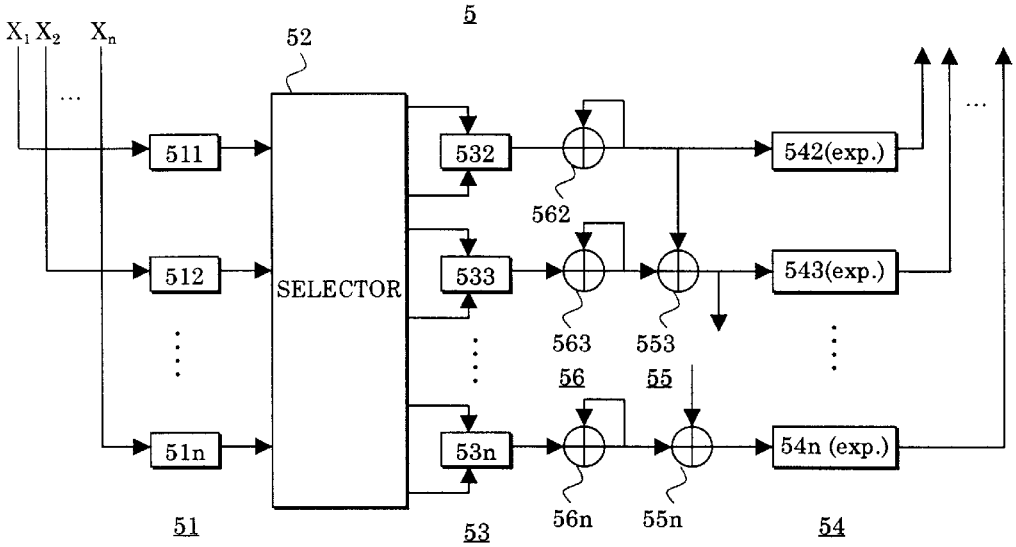
FIG. 11 is a block diagram showing another embodiment of a phase correction arithmetic portion used in an array antenna receiving device according to the present invention.

FIG. 11 shows an embodiment (2) of the feedback-arranged phase correction arithmetic portion 5 in the array antenna receiving device according to the present invention shown in FIG. 1B. In this embodiment, searchers 51, a selector 52, phase deviation arithmetic portions 53, phase correction weight calculators 54, and adders 553–55*n* (generally referred to as "55") are the same as in the embodiment (1) of the phase correction arithmetic unit shown in FIG. 9. However, adders 562–56*n* (generally referred to as "56") are provided at the latter stage of the phase deviation arithmetic portions 53 to add the last phase correction quantities with new phase correction quantities, respectively. Namely the adders 56 serve to hold the last phase correction quantities by taking advantage of the feedback-arranged phase compensation calculating the next phase correction quantity from the previous one.

Figure 12:
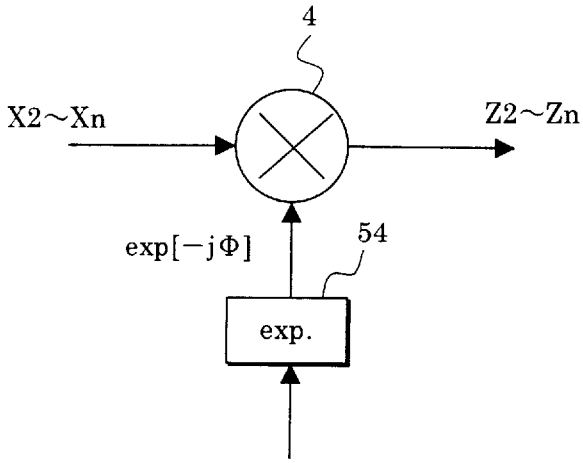
FIG. 12 is a block diagram showing an embodiment of a phase rotator used in an array antenna receiving device according to the present invention.

FIG. 12 shows an embodiment of the phase rotators 4 in the array antenna receiving device according to the present invention shown in FIG. 1. Each of the phase rotators 4 include a multiplier for multiplying the output signals from the receivers with a phase-correction-weighted value after the term "exp [−jΦ]" having been performed by the phase weight calculators 54 in either of the embodiments shown in FIGS. 1A and 1B.

Figure 13:
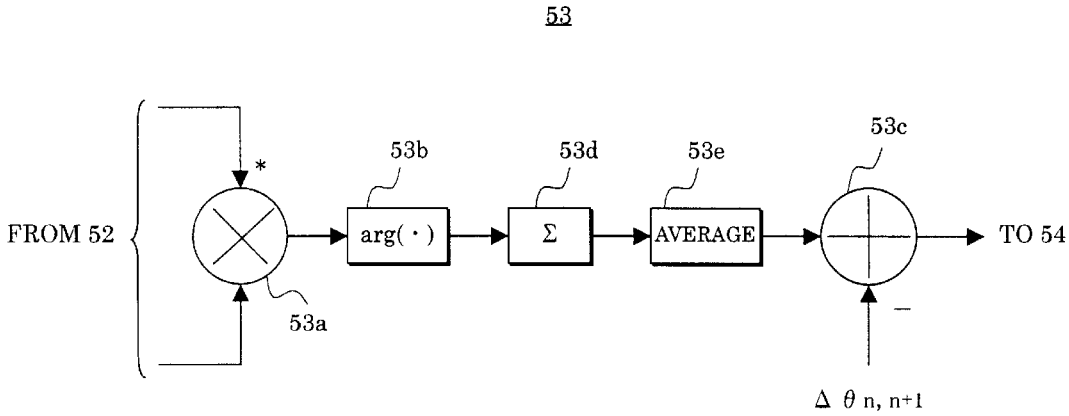
FIG. 13 is a block diagram showing another embodiment of a phase deviation arithmetic portion used in an array antenna receiving device according to the present invention.

FIG. 13 shows a modified example for the embodiment (1) of the phase deviation arithmetic portions 53 shown in FIG. 10, in which an integrator 53d and an average value calculator 53e are provided between the phase term arithmetic portion 53b and the subtracter 53c, different from the embodiment (1).

Namely, the selector 52 connected to this embodiment portion selects two or more signals, which are not limited to plural different user signals but may be made by single user multipath signals. The phase deviation arithmetic portion 53 sums at the integrator 53d the operated result obtained from the phase term calculator 53b in accordance with Eq.(4) and calculates the average value at the average value calculator 53e for the subtracter 53c.

Accordingly, while the phase deviation arithmetic portion 53 in FIG. 10 continuously outputs the phase deviation Φ, that in FIG. 13 equivalently operates the phase difference Φ at a fixed time interval, whereby the phase correction quantities supplied to the phase weight calculators 54 become more reliable in the latter portion.

Figure 14:
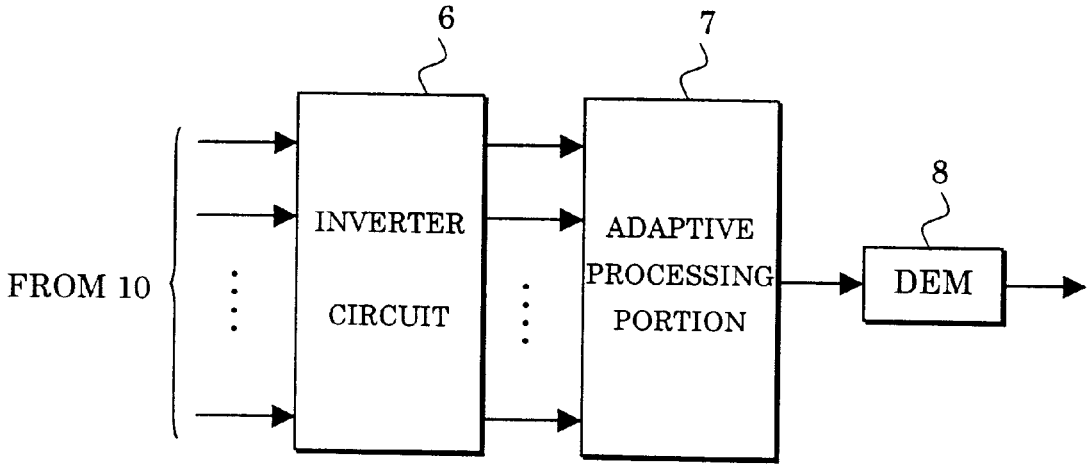
FIG. 14 is a block diagram showing an example of an inverter circuit of an array antenna receiving device according to the present invention.

FIG. 14 shows an arrangement of the array antenna receiving device according to the present invention, particularly at the latter stage of the phase compensator 10 shown in FIG. 1. In this arrangement, the inverter circuit 6 executes the inverse operation to the beam former 2 with the signals after having been phase-corrected by the phase compensator 10. This enables signals to be output respectively equivalent to the signals received by each of the antenna elements 1 to the adaptive processing portion 7.

In other words, to the adaptive processing portion 7 the phase-corrected signals by the phase compensator 10 which are preserved with phase difference information determined by the arrival direction of the user 1 signal and the array of the antenna elements 1 are supplied.

The output signal of the adaptive processing portion 7 after having been performed with certain adaptive processing is input to a demodulator (DEM) 8 to complete an adaptive array antenna arrangement. It should be noted that such adaptive processing by the adaptive processing portion 7 is not limited to the above embodiments but applicable to any processing which receives the output signals of the antenna elements.

Figure 15:
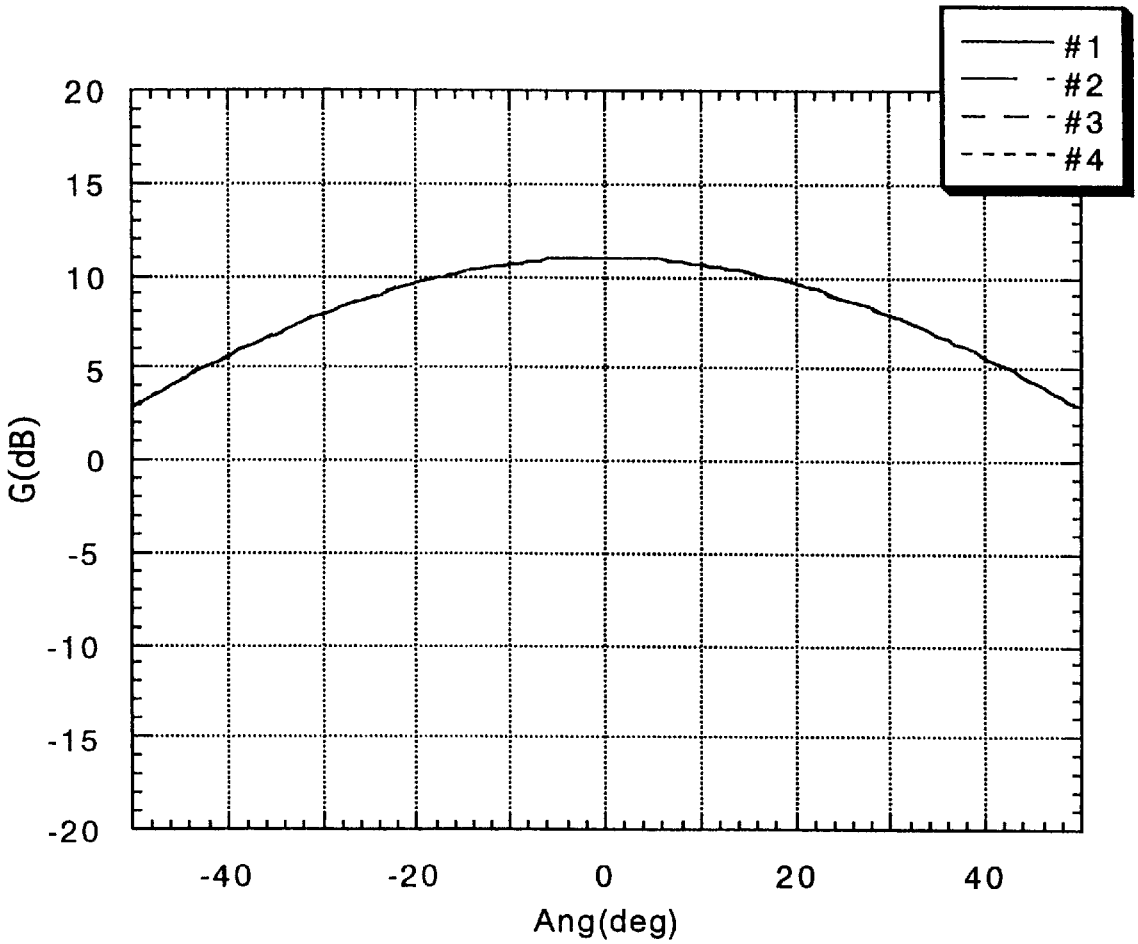
FIG. 15 is a graph showing a radiation characteristic produced after an inversion by an inverter circuit used in an array antenna receiving device according to the present invention.
Figure 16:
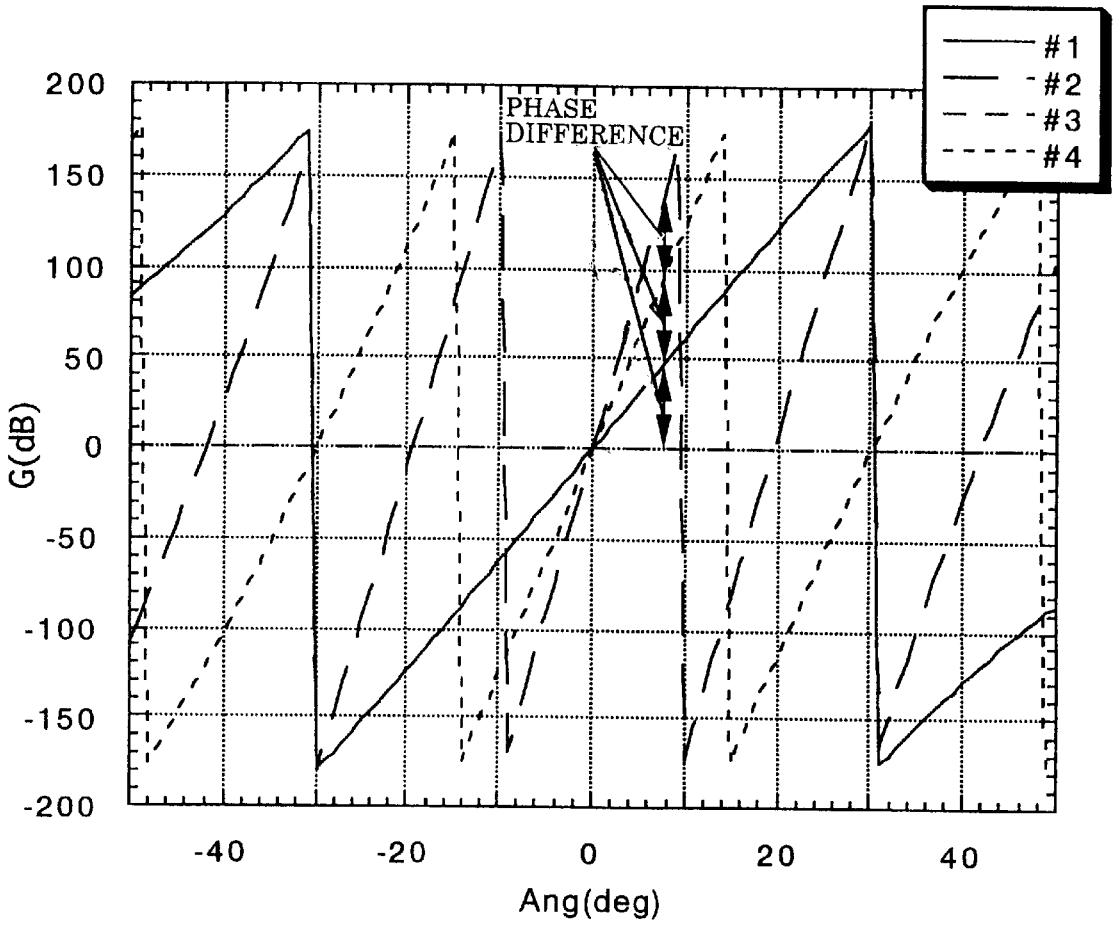
FIG. 16 is a graph showing a phase characteristic produced after an inversion by an inverter circuit used in an array antenna receiving device according to the present invention.

FIGS. 15 and 16 respectively show a radiation characteristic and a phase characteristic after the beam inversion at the inverter circuit 6 of FIG. 14. As seen from FIG. 15, the radiation characteristic exhibits the same as that of a single antenna element. It is also seen from FIG. 16 that the phase differences are shown equal to each other as in the case received by an array antenna where a phase difference between the receivers determined by the arrival direction of the user signals and the array of the antenna elements is preserved.

Figure 17:
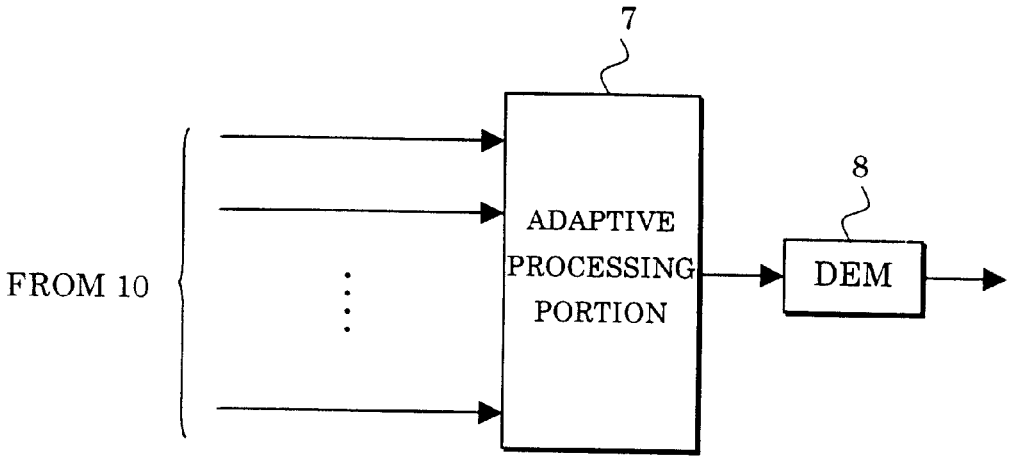
FIG. 17 is a block diagram showing an example of an array antenna receiving device according to the present invention wherein the inverter circuit has a through arrangement.

Also, the inverter circuit may be eliminated to provide a through arrangement without any operations as shown in FIG. 17 in order for the adaptive processing portion 7 to input the output signals of the phase compensator 10 directly, which realizes a beam-space adaptive array antenna arrangement.

Figure 18:
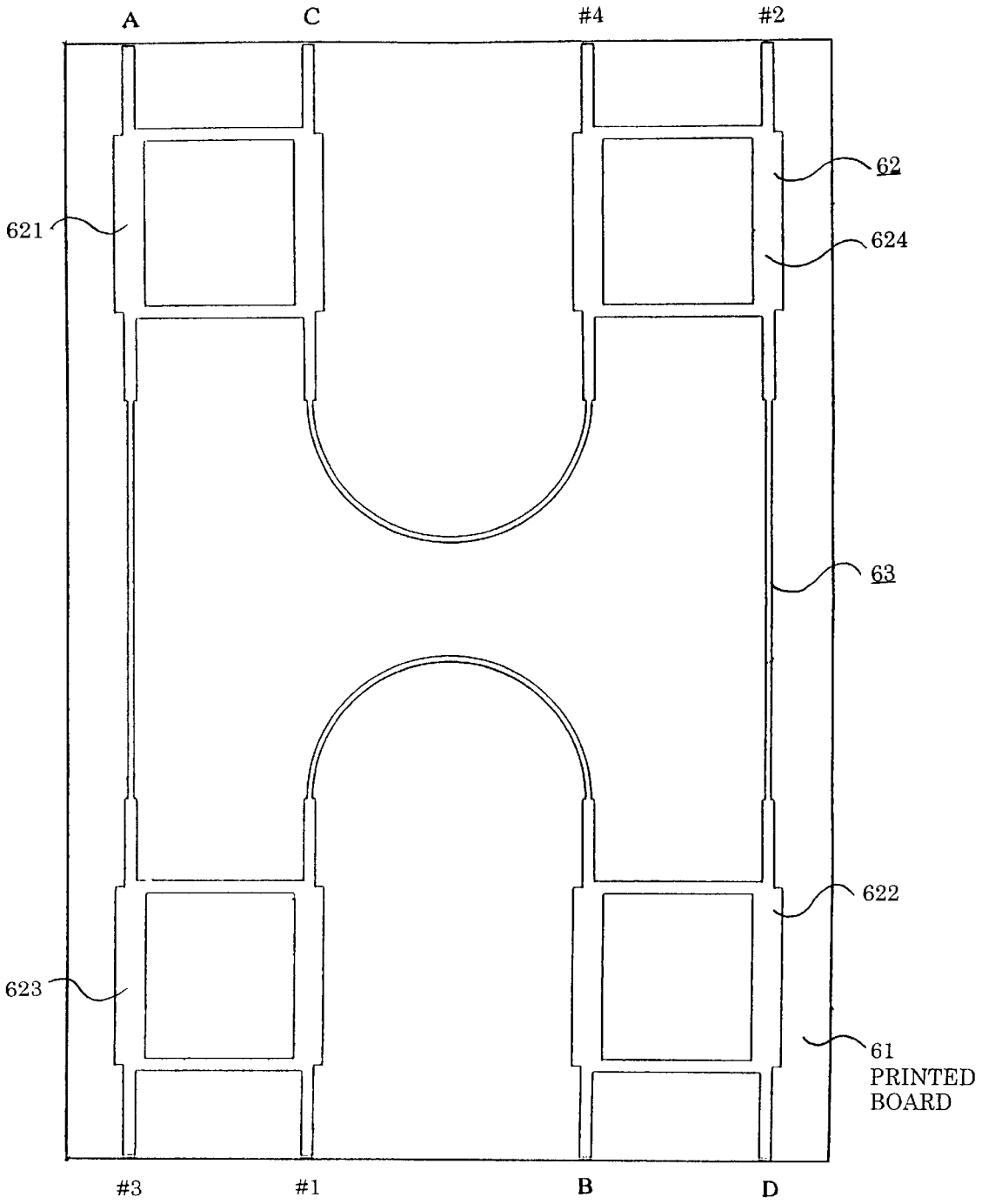
FIG. 18 is a plain view showing an embodiment of an analog beam former used in an array antenna receiving device according to the present invention.

FIG. 18 shows an embodiment of the 4×4 analog beam former 2 shown in FIG. 2. In this embodiment, the beam former 2 is composed of 3 dB90° hybrid circuits 621–624 (generally referred to as "62") made of a micro strip line, and a phase shifter 63 adjustable with a line length on a printed-board 61.

Figure 19:
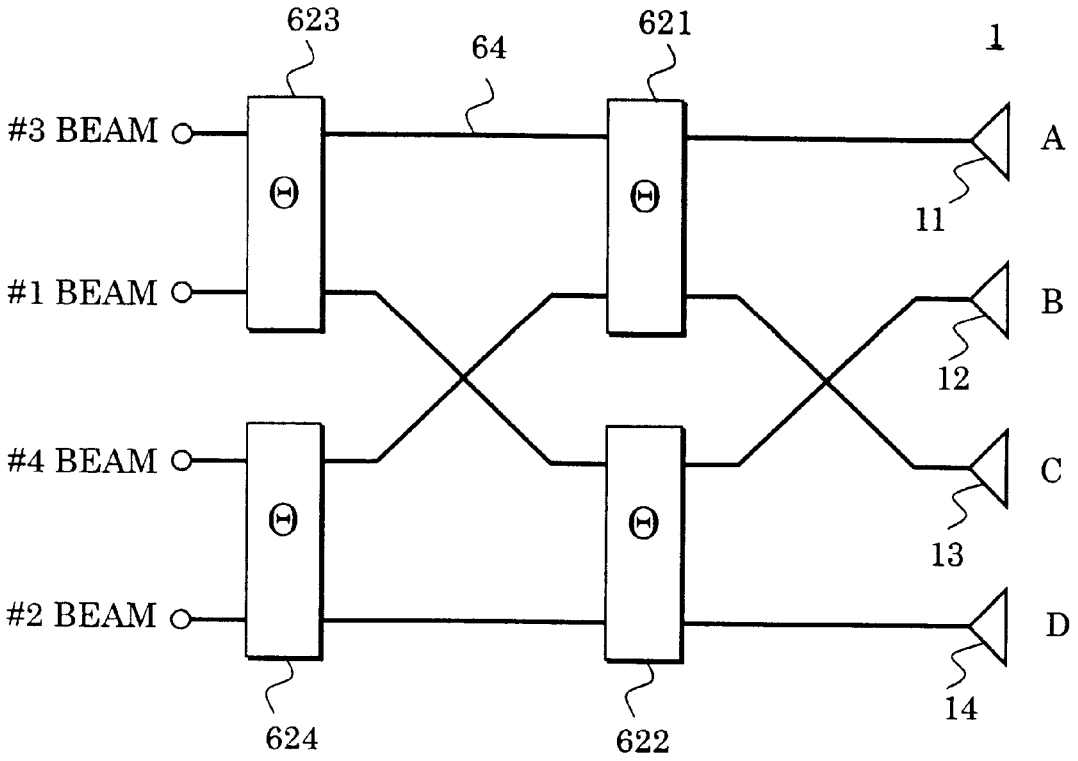
FIG. 19 is a circuit diagram showing an embodiment of an analog beam former used in an array antenna receiving device according to the present invention.

It is to be noted that this beam former 2 is not limited to this structure but as shown in FIG. 19, the 3 dB90° hybrid circuits 62 may be employed separately, and joined in three dimensions with a coaxial line 64 or the like also serving as a phase shifter. This is the same as the 8×8 beam former shown in FIG. 5.

Although the above embodiments suppose a case where users exist uniformly within a sector, there may be actually no such supposed state. The users may exist only in one direction within a sector in an ultimate case, in which it is impossible to perform an appropriate phase compensation and beam forming.

Figure 20A:
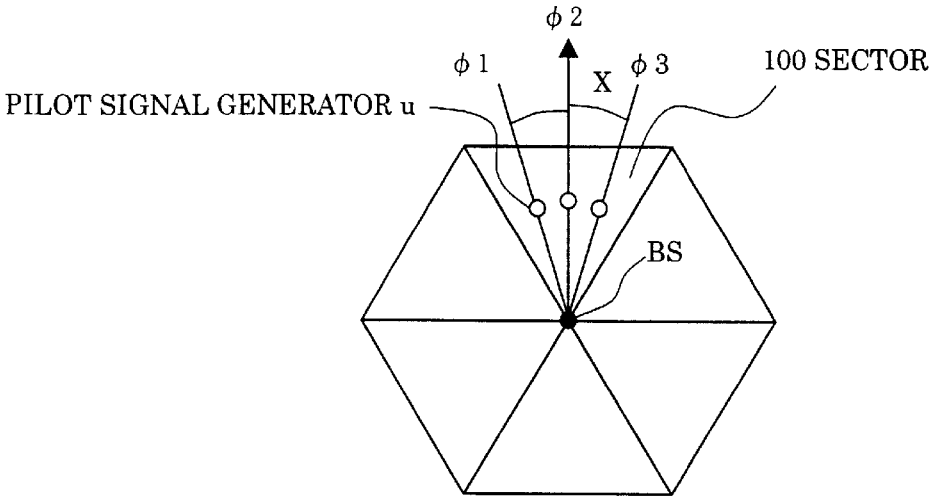
FIGS. 20A and 20B are diagrams showing an uplink signal generator provided in a sector for an array antenna receiving device according to the present invention.

As shown in FIG. 20, a pilot signal generator u may be preliminarily provided in a sector 100 covered by a radio base station BS. Particularly, assuming that an antenna directed to the sector 100 as shown in FIG. 20A comprises a 4-element linear array antenna, it is preferable to choose angles Ø1, Ø2 (=0°), and Ø3 within the arrival angle regions a–c in the radiation characteristic of the analog beam former shown in FIG. 3, or to choose an angle in the vicinity of a contact between adjacent beams for arranging the received levels if possible. It should be noted that in this embodiment the uplink signal generator does not have to be strictly positioned.

Thus, at least three reference signals are required to form four beams with four antennas. Each of the reference signals is used to calculate the phase correction quantity in the same manner as the above embodiments.

Figure 20B:
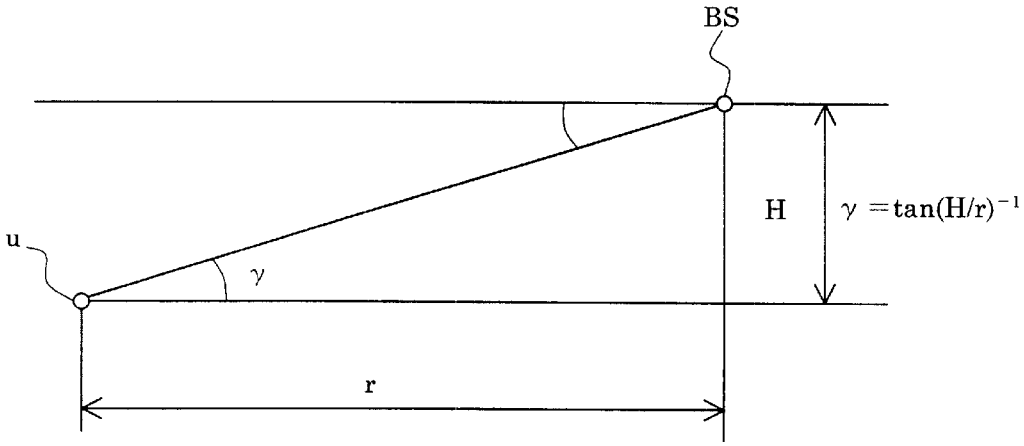

FIG. 20B shows an arrival angle in a vertical plane, which needs no modification in arrangement particularly irrespective of a value of γ.

Figure 21:
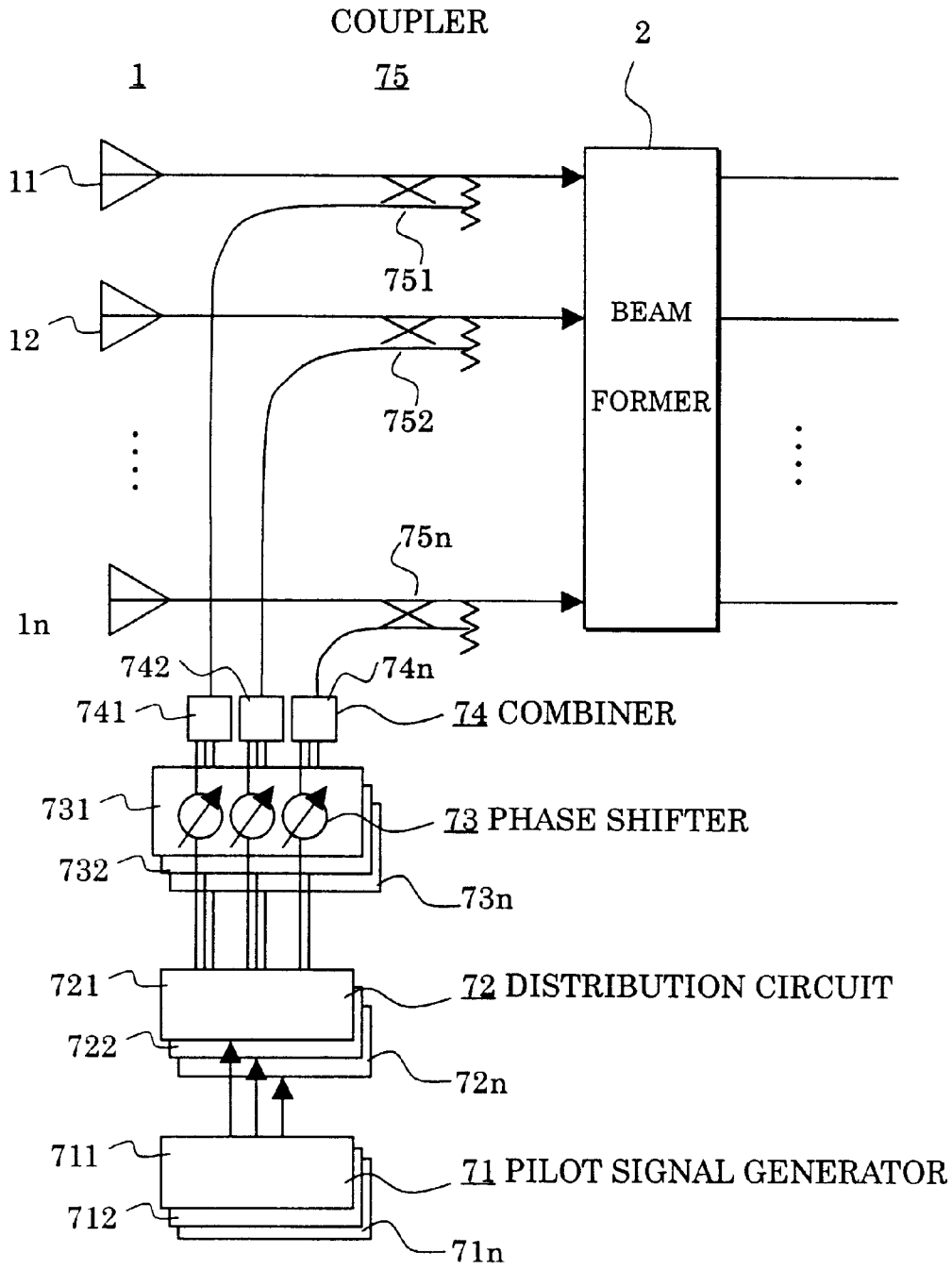
FIG. 21 is a block diagram showing an embodiment of an uplink signal generator combined in a radio base station with an array antenna receiving device according to the present invention.

FIG. 21 shows an embodiment incorporating an uplink pilot signal generator in the radio base station. Assuming that the antenna directive to the sector 100 as shown in FIG. 20A comprises a 4-element linear array antenna, a signal generator 71 produces more than three kinds of uplink signals, which are distributed by distribution circuits 721–72*n* (generally referred to as "72").

Phase shifters 731–73*n* (generally referred to as "73") then establish pseudo arrived directions of the signals within the area of the arrival angle regions a–c in FIG. 3, or an angle in the vicinity of a contact between adjacent beams for arranging the received levels if possible. It is unnecessary in the present invention to set a strict arrival direction.

After the reference signals are combined by combiners 741–74*n* (generally referred to as "74"), the combined signals are then input to couplers 751–75*n* (generally referred to as "75") between the antenna elements 1 and the analog beam former 2. Therefore, it is possible to calculate the phase correction quantities in the same manner as the case of an actual user signal using those reference signals. This device can be utilized as a standby where no user signal is obtained in a predetermined arrival angle distribution, whereby it becomes possible to improve the reliability of the radio base station.

As described above, an array antenna receiving device according to the present invention is arranged such that an analog beam former makes a composite beam so that a phase difference between adjacent beams may have a fixed value determined by beams to be selected. Further, a phase compensator provides digital signals for receivers with phase correction quantities based on any one of the digital signals so that phase differences between the antenna elements may have the fixed value. In other words, it is arranged that a phase deviation of an active circuit portion (receiver) by using inter-antenna branch phase information of a passive circuit portion such as antenna and analog beam former without any phase deviation may be compensated. Thus, it becomes possible to perform beam forming which is higher in adaptive processing reliability and efficiency due to signals after the phase compensation. This largely contributes to a realization of a multi-beam antenna, or adaptive array antenna receiving device in digital domain.

What is claimed is:

1. An array antenna receiving device comprising:

a plurality of antenna elements arrayed in parallel for receiving input signals;

an analog beam former for combining the input signals into composite beams in such a way that phase differences between adjacent beams have respectively fixed values determined relative to selected output beam combination;

a plurality of receivers which convert the composite beams of the beam former into digital signals; and a phase compensator which compensates the digital signals with phase correction quantities thereby removing, relative to any one of the digital signals, phase deviations from the respective fixed values of phase differences in order for said digital signals to maintain said fixed values.

2. The array antenna receiving device as claimed in claim 1, wherein the phase compensator includes an arithmetic portion for multiplying the digital signals between adjacent beams with a difference of the fixed value to determine the phase correction quantities and a plurality of phase rotators for phase-rotating the digital signals by the phase correction quantities except for a reference one of the digital signals.

3. The array antenna receiving device of claim 2, wherein the arithmetic portion uses a signal higher in reception level as any one of the digital signals to be selected of beams having adjacent directivities and being simultaneously received.

4. The array antenna receiving device of claim 2, wherein the arithmetic portion uses an average value of signals in excess of a predetermined level as any one of the digital signal to be selected of beams having adjacent directivities and being simultaneously received.

5. The array antenna receiving device of claim 1, wherein the phase compensator includes a plurality of phase rotators for phase-rotating the digital signals of the receivers by the phase correction quantities except for a reference one of the digital signals, and an arithmetic portion for receiving the reference one of the digital signals and output signals of the phase rotators to multiply the digital signals between adjacent beams with a difference of the fixed value to determine the phase correction quantities.

6. The array antenna receiving device of claim 5, wherein the arithmetic portion uses a signal higher in reception level as any one of the digital signals to be selected of beams having adjacent directivities and being simultaneously received.

7. The array antenna receiving device of claim 5, wherein the arithmetic portion uses an average value of signals in excess of a predetermined level as any one of the digital signal to be selected of beams having adjacent directivities and being simultaneously received.

8. The array antenna receiving device of claims 1, wherein the beam former comprises power distribution circuits and phase shifters.

9. The array antenna receiving device of claim 1, further comprising a generator for generating uplink pilot signals forming a reference in any direction in a communication area, the phase compensator converting the uplink signal into the digital signals provided with the phase correction quantities.

10. The array antenna receiving device of claims 1, further comprising a generator for generating uplink pilot signals to distribute output signals of the generator to receiving routes, the phase compensator using the uplink signals as receiving signals between the antenna elements and the beam former with the fixed phase difference to generate the digital signals provided with the phase correction quantities.

11. The array antenna receiving device of claims 1, further comprising an inverter circuit which performs an inverse conversion of the beam former so that output signals of the phase compensator are equivalent to the input signals per a single antenna element; and an adaptive processing portion which combines output signals of the inverter circuit to form the adaptive antenna pattern.

* * * * *